United States Patent [19]

Teel

[11] 3,972,701

[45] Aug. 3, 1976

[54] ELECTROSTATIC PRECIPITATOR HAVING ELECTRODE STABILIZER MEANS

[75] Inventor: Kalle Teel, Baltimore, Md.

[73] Assignee: Environmental Elements Corporation, Baltimore, Md.

[22] Filed: Dec. 9, 1974

[21] Appl. No.: 530,618

[52] U.S. Cl. ..... 55/146; 55/148; 55/153

[51] Int. Cl.[2] ..... B03C 3/00

[58] Field of Search ..... 55/140, 146–149, 55/153, 157; 174/137 R

[56] References Cited

UNITED STATES PATENTS

| | | | |
|---|---|---|---|
| 1,869,475 | 8/1932 | Hale | 55/146 X |
| 2,197,562 | 4/1940 | Reinker | 174/137 R |
| 2,362,716 | 11/1944 | Phillips | 55/146 |
| 2,601,906 | 7/1952 | Wintermute | 55/147 |
| 2,711,224 | 6/1955 | Herber | 55/147 |
| 2,775,640 | 12/1956 | Stevens | 55/146 X |
| 2,999,561 | 9/1961 | Phyl | 55/140 X |
| 3,483,670 | 12/1969 | Quintilian et al. | 55/147 X |
| 3,755,611 | 8/1973 | Queck et al. | 55/146 X |

*Primary Examiner*—Frank W. Lutter
*Assistant Examiner*—David L. Lacey
*Attorney, Agent, or Firm*—Boyce C. Dent; Oscar B. Brumback

[57] ABSTRACT

An electrostatic precipitator for cleaning a particle laden gas passing therethrough comprising a shell having a gas inlet and outlet port and defining a gas chamber therein, a plurality of laterally spaced collector electrodes suspended within the gas chamber defining gas passages between adjacent collector electrodes, a discharge electrode assembly suspended from an insulator within the gas chamber, a portion thereof suspended within the gas passages between the adjacent collector electrodes, the discharge electrode assembly being insulated by the insulator from the shell and the collector electrodes, and a plurality of electrically insulating stabilizers connected between selected ones of the collector electrodes and the discharge electrode assembly for maintaining the portion of the discharge electrode assembly suspended within the gas passages substantially centered between the adjacent collector electrodes.

8 Claims, 4 Drawing Figures

ELECTROSTATIC PRECIPITATOR HAVING ELECTRODE STABILIZER MEANS

BACKGROUND OF THE INVENTION

1. Field of the Invention

This invention relates generally to gas separation by electrostatic precipitators and more particularly to an electrostatic precipitator having a discharge electrode assembly stabilizing means for maintaining discharge electrode wires substantially centered between adjacent collector electrodes.

2. Description of the Prior Art

Removal of particles from a gas stream by plate type electrostatic precipitators is well known in the art. In such precipitators, a particle laden gas flows through an inlet port in the precipitator shell; into a gas chamber in the electrostatic precipitator, and through gas passages which are formed between laterally spaced rows of vertical collector electrodes suspended within the gas chamber. Suspended in each of the gas passages between adjacent collector electrodes are a plurality of discharge electrode wires which are electrically insulated from the shell of the precipitator. As the particle laden gas passes through the gas passages between the collector electrodes, the discharge electrode wires are energized, creating an electrostatic field around each discharge electrode wire which ionizes the particles in the gas. The ionized particles are then attracted to and collected on the collector electrodes. The collector electrodes are then rapped to dislodge the particles therefrom and the particles fall to the bottom of the precipitator into collection hopper from where they are disposed of outside the precipitator system.

It has been found that the electrostatic field surrounding the discharge electrode wires tends to oscillate the wires within the gas passages. As the wires oscillate, they come within close proximity to adjacent collector electrodes. When the wires come too close to a collector electrode, arcing will occur between the wire and the collector electrode. Such arcing is detrimental to the operation of the precipitator system because it reduces the strength of the electrostatic field surrounding the discharge wires and thus decreases the efficiency of the system. In addition, it causes damage to the collector electrodes and the discharge electrode wires. For this reason, it is desirable to maintain the wires within the gas passages without any significant oscillation.

To help prevent oscillation of the discharge wires, weights are usually attached to the bottom of the wires. The weights tend to keep the wires straight because they present a greater mass for the electrostatic field to overcome in order to oscillate the wires. For many years the use of weights attached to the bottom of the wires was satisfactory because the electrostatic fields used were relatively weak and the discharge wires were relatively short. However, in modern electrostatic precipitators, high strength electrostatic fields are common and the discharge wires are much longer so that oscillation of the wires still occurs even with weights attached. To counteract this oscillation, a weight guide grid system is now used, being suspended below the bottom of the collector electrodes from a top frame supporting the discharge electrode wires thereby insulating the grid from the shell of the precipitator. The bottom grid system is arranged so that the weights from the wires are suspended within the grid system. The grids prevent the discharge wires and weights from oscillating to a limited degree. However, the size of electrostatic precipitators continues to be increased and collector electrodes 24 to 35 feet or longer are common. The discharge electrode wires are even longer than the collector electrodes and may be from 24 to 35 feet or longer. With wires this long, it has been found that even with a rigid weight guide grid frame suspended beneath the collector electrodes, the electrostatic fields are so strong that the entire wire and grid system tend to swing and thus the same problem develops in that arcing occurs between the wires and the collector electrodes.

One method now used to prevent the bottom weight guide grid frame and discharge wires from swinging is to anchor the bottom weight guide grid frame to the wall of the electrostatic precipitator hopper which is located below the collector electrodes. Insulators must be used to anchor the grid since the wall of the hopper is at a different potential than the discharge wires and bottom weight guide grid system. Although anchoring the bottom weight guide grid frame to the hopper wall prevents the frame from oscillating, it does have a number of disadvantages.

One disadvantage of the above system is that the insulators are located below the hot gas stream and the temperature below the collector electrode plates may go below the dew point. If this happens, condensation will form on the insulators which may cause an electrical short between the discharge wires and the hopper resulting in a break down of the electrostatic precipitator. In addition, since the insulators are located below the collector electrodes, dust building up in the collection hopper may reach the insulator and result in an electrical short. Another disadvantage of anchoring the bottom weight guide grid frame to the hopper is that it is at a different temperature than the hopper which is below the hot gas stream while the weight guide grid frame is within the hot gas stream. Thus, there is considerable difference in the thermal expansion between the hopper and the bottom weight guide grid frame. This difference tends to pull the weight guide grid frame out of alignment and closer to one of the collector electrodes. When this happens, arcing may occur.

Another system used to prevent the discharge electrode wires and bottom weight guide grid frame from swinging consists of a number of rigid trusses between the top discharge electrode support frame and the bottom weight guide grid frame. Out of necessity, these trusses must be extremely large. Since the space between the collector electrodes is relatively small, at least one collector electrode section must be removed from the system in order to use a truss big and strong enough to prevent swinging. Since a number of these trusses must be used, a number of collector electrode sections must be removed. Removing the collector plates is undesirable since spaces will be left where no particles will be collected. In addition, trusses must be used which are of 24 to 35 feet or more in length and are extremely expensive. Since the two above described methods of preventing the discharge electrode wires and bottom weight guide grid frame from oscillating has proved to be ineffective or far too expensive, a new and inexpensive system is needed to overcome the above problems.

SUMMARY OF THE INVENTION

Accordingly, an object of the present invention is to provide an electrostatic precipitator having a discharge electrode stabilizer system that will overcome the aforementioned disadvantages and others. Thus, this invention provides an electrostatic precipitator with a rigid insulator stabilizer means connected between the collector electrodes and the bottom weight guide grid frame which substantially prevents any oscillation or swinging of the discharge electrode and particularly, the bottom weight guide grid frame.

This is generally accomplished by providing an electrostatic precipitator with a shell having a gas inlet and outlet port and defining a gas chamber therein; a plurality of lateraly spaced collector electrodes suspended within the gas chamber and defining gas passages between adjacent collector electrodes; a discharge electrode assembly suspended from an insulating means within the gas chamber, a portion thereof being suspended within the gas passages between the adjacent collector electrodes, with the discharge electrode assembly being insulated by the insulating means from the shell; and a plurality of stabilizer electrically, insulating means connected between selected ones of the collector electrodes and the discharge electrode assembly for maintaining that portion of the discharge electrode assembly within the gas passages substantially centered between the adjacent collector electrodes.

The above and further objects and novel features of the invention will appear more fully from the following detailed description when the same is read in connection with the accompanying drawings. It is to be expressly understood, however, that the drawings are not intended as a definition of the invention but are for the purpose of illustration only.

BRIEF DESCRIPTION OF THE DRAWINGS

In the drawings wherein like parts are marked alike.

DESCRIPTION OF THE PREFERRED EMBODIMENT

Figure 1:
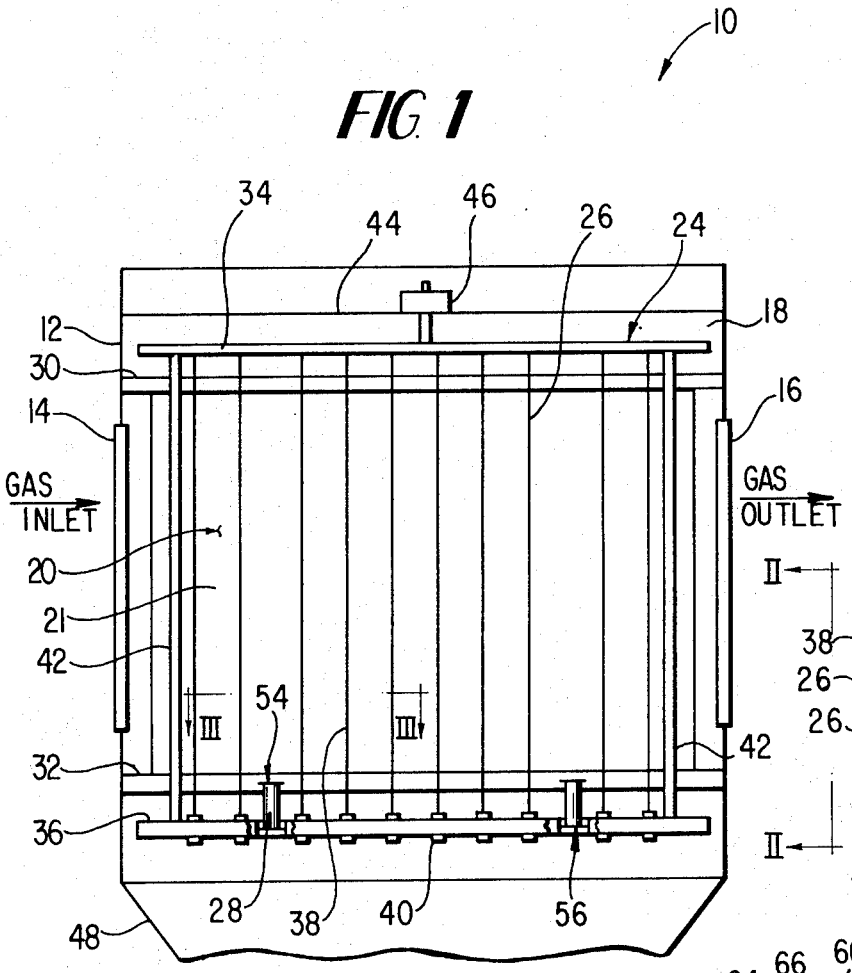
FIG. 1 is a schematic illustration in side elevation of an electrostatic precipitator generally showing the collector electrodes, the discharge electrode assembly, and the electrically insulating stabilizer means of the present invention.

Referring to FIG. 1, the invention generally comprises an improved electrostatic precipitator, denoted generally by numeral 10, for cleaning a particle laden gas passing therethrough. Precipitator 10 includes a shell 12 having a gas inlet port 14 and a gas outlet port 16 and defining a gas chamber 18 therein. A plurality of lateral spaced collector electrodes, denoted generally by numeral 20, are suspended within gas chamber 18 defining gas passages 22 (FIG. 2) between adjacent collector electrodes 20. A discharge electrode assembly, denoted generally by numeral 24, is suspended by an insulator 46 within gas chamber 18, a portion 26 thereof being suspended within gas passages 22 between adjacent collector electrodes 20. A plurality of electrically insulating stabilizer means 28 are connected between selected ones of collector electrodes 20 and discharge electrode assembly 24 for maintaining portion 26 of discharge electrode assembly 24 substantially centered between adjacent collector electrodes 20.

Figure 2:
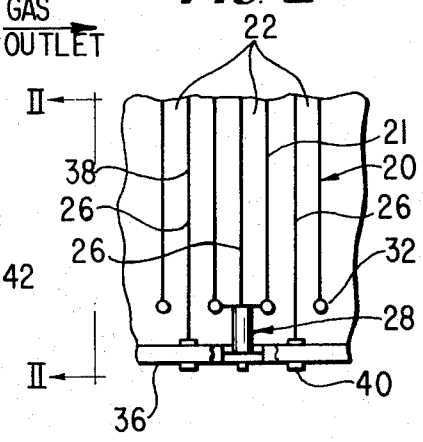
FIG. 2 is a schematic end view of a portion of the electrostatic precipitator of FIG. 1 taken along the lines II—II showing the gas passages between adjacent collector electrodes and the electrically insulating stabilizer means connected between adjacent collector electrodes and the discharge electrode assembly.

More specifically, in the present invention as shown in FIGS. 1 and 2, precipitator 10 comprises a shell 12 which completely encloses the internal components of precipitator 10. Shell 12 includes a gas inlet port 14 through which a particle laden gas enters gas chamber 18. The particle laden gas is brought to gas inlet port 14 by any conventional means, such as by gas ducts (not shown). A gas outlet port 16 is located on shell 12 opposite the wall that contains gas inlet port 14. Once the particle laden gas has been cleaned in gas chamber 18, the clean gas exits from shell 12 through gas outlet port 16 and is disposed of in the conventional manner such as by a gas stack (not shown).

Precipitator 10 further includes a hopper 48 located at the bottom of precipitator 10. As the particles are removed from the particle laden gas, they are collected on collector electrodes 20, to be described in detail later. The particles are removed from collector electrodes 20 in any conventional manner such by rapping collector electrodes 20 with conventional rappers (not shown) which cause the particles to fall to the bottom of precipitator 10 into hopper 48 for subsequent disposal outside the precipitator system in the conventional manner.

Referring again to FIGS. 1 and 2, suspended within gas chamber 18 of precipitator 10 is a plurality of collector electrodes 20. The collector electrodes 20 are laterally spaced within gas chamber 18 so that each collector electrode 20 extends parallel to the gas flow through precipitator 10 as shown by the arrows in FIG. 1. Since collector electrodes 20 are laterally spaced within gas chamber 18, they form gas passages 22 between adjacent collector electrodes as shown in FIG. 2.

Each collector electrode 20 includes a top support beam 30 which extends along the length of shell 12 just above gas inlet and outlet ports 14 and 16. Top support beam 30 is connected to shell 12 at each end such as by welding or if desired top support beam 30 may be suspended within brackets (not shown) which have been welded to shell 12. Each collector electrode 20 further includes a bottom rigid beam 32 which is spaced below gas inlet and outlet ports 14 and 16 and extends the length of shell 12. Bottom beam 32 is attached to the ends of the shell 12 similar to that described for top beam 30. Bottom beam 32 is vertically aligned with each top beam 30. An electrically grounded collector plate 21 extends substantially the length of shell 12 and is connected between top beam 30 and bottom beam 32 such as by welding. Plate 21 is usually formed from a plurality of relatively narrow sections interlocked to form a continuous plate. Top beam 30, bottom beam 32 and collector plate 21 form each collector electrode 20. A plurality of gas passages 22 (FIG. 2) are formed between adjacent collector electrodes 20 through which the particle laden gas passes until the clean gas reaches gas outlet port 16.

Figure 3:
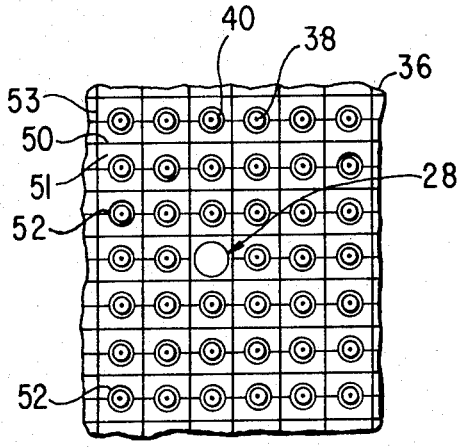
FIG. 3 is a schematic top view of a portion of the bottom weight guide grid frame of FIG. 1 taken along the lines III—III showing the discharge wire weights suspended within the bottom weight guide grid frame and the electrically insulating stabilizer means secured within the bottom weight guide grid frame.

Referring now to FIGS. 1, 2, and 3, discharge electrode assembly 24 is suspended from an insulator 46 within gas chamber 18 of precipitator 10 so that it is electrically insulated by insulator 46 from shell 12 and from collector electrodes 20. Discharge electrode assembly 24 includes a plate 44 (FIG. 1) which is spaced above collector electrodes 20 and connected to each side of shell 12 such as by welding. A top support grid 34 is suspended from plate 44 by securing grid 34 to an electrical insulator 46 which is supported by plate 44. Top support grid 34 may be secured to insulator 46 by bolts in the conventional manner to insulate grid 34 from shell 12. A plurality of spaced discharge electrode wires 38 are suspended from top support grid 34 so that they extend through gas passages 22 between adjacent collector electrodes 20. As shown in FIG. 1, the discharge electrode wires 38 are longitudinally spaced along top support grid 34 substantially the length of collector plate 21 and extend below the bottom of collector electrodes 20. Preferably, a weight 40 is secured to the end of each discharge wire 38 to keep them straight and to help prevent any oscillation of the wires 38 due to the electrostatic field around each wire 38.

A bottom weight guide grid frame 36 is suspended from top support grid 34 by a plurality of support rods 42 and below the bottom of collector electrodes 20 in vertical alignment with top support grid 34. Support rods 42 are connected, such as by welding, between top grid 34 and bottom frame 36. Bottom frame 36 includes a plurality of laterally spaced guide plates 50, as shown in FIG. 3, running substantially the length of shell 12. Frame 36 also includes a plurality of longitudinally spaced grid plates 53 extending substantially the width of shell 12. The grid plates 50 and 53 are interconnected such as by welding, to form a grid pattern beneath collector electrodes 20 as shown in FIG. 3, that is, the interconnected grid plates 50 and 53 form a plurality of squares 51 bound on each side by grid plates 50 and 53. Each square 51 is aligned with a discharge wire 38. Connected between adjacent guide plates 53 is a weight guide member 52 which is preferably made from a rigid wire formed with a circular center section connected between adjacent grid plates 53 such as by welding. Each weight 40 connected to the end of each discharge wire 38 is suspended within the circular center section of each weight guide member 52. The weight guide members 52 restrain the weights 40 within the circular center sections so that wires 26 do not oscillate along their length between weights 40 and top support 24.

Figure 4:
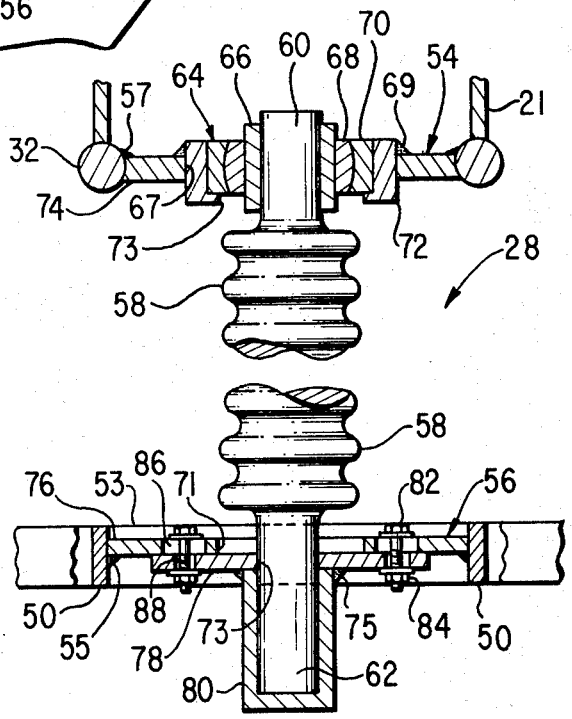
FIG. 4 is an enlarged cross-sectional view of the electrically insulating stabilizer means of FIG. 1 showing its preferred construction and mounting between the collector electrodes and the bottom weight guide grid frame of the discharge electrode assembly.

An electrically insulating stabilizer means 28 is connected between pairs of collector electrodes 20 and grid frame 36. Preferably, there are four electrically insulating stabilizer means 28, one of which is positioned substantially at each corner of frame 36. Although the preferred number of electrically insulating stabilizer means 28 is four, it should be understood, however, that more or less than four electrically insulating stabilizer means 28 may be used. As shown in FIGS. 1, 2 and 4, electrically insulating stabilizer means 28 is connected to a pair of adjacent bottom beams 32 of collector electrodes 20 to provide a strong rigid base for connecting electrically insulating stabilizer means 28. Electrode plate 21 is ordinarily made of thin sheet metal and thus would not provide a strong enough base for connecting electrically insulating stabilizer means 28.

Electrically insulating stabilizer means 28 comprises a top support assembly, denoted generally by numeral 54, connected, such as by welding or bolting, between adjacent bottom beams 32 of electrodes 20. A bottom support assembly, denoted generally by numeral 56, is vertically aligned with top support assembly 54 and is positioned within a square 51 of bottom weight guide grid frame 36 which is in line with top support assembly 54. Bottom support assembly 56 is rigidly secured to the guide plates 50 and 53 such as by a weld 55. It should be understood that when utilizing electrically insulating stabilizer means 28, a discharge wire must be eliminated to provide a space for electrically insulating stabilizer means 28 in square 51 usually occupied by weight 40. Although four discharge wires 38 are eliminated by the use of four electrically insulating stabilizer means 28, no detrimental results or appreciable decrease in efficiency will result because of the large number of discharge wires 38 that are used.

FIG. 4 shows the preferred construction of stabilizer means 28 in detail. Electrically insulating stabilizer means 28 generally comprises a top support assembly 54 which is connected between bottom beams 32 of adjacent collector electrodes 20 such as by a weld 57. A bottom support assembly 56 is secured, as previously mentioned, to grid plates 50 and 53 which form a square 51 in bottom weight guide grid frame 36. A strong rigid electrical insulator 58 extends between and is attached to top support assembly 54 and bottom support assembly 56. Insulator 58 electrically insulates collector electrodes 20 from discharge electrode assembly 24 while at the same time stabilizes discharge electrode assembly 24 with respect to collector electrodes 20. Since collector electrodes 20 are connected to shell 12, they provide a rigid and stable support for electrically insulating stabilizer assembly 28 and will in turn stabilize bottom weight guide grid frame 36 and discharge wires 38.

Referring again to FIG. 4, top support assembly 54 comprises a plate 74 secured to adjacent bottom beams 32 and includes an opening 67 extending therethrough substantially centered in plate 74 within which a tubular bushing holder 72 is secured by weld 69. A conventional, commercially available ball bushing assembly, denoted generally by numeral 64 rests within opening 67 against a flange 73 on plate 74. Bushing assembly 64 includes an inner ring 68 having a convex outer surface seated with an outer ring 70 having a matching concave surface so that inner ring 68 universally swivels within outer ring 70. A sleeve 66 is placed within inner ring 68 and is secured thereto such as by a press fit.

The bottom support assembly 56, secured within squares 51 of bottom weight guide grid frame 36, comprises a top plate 76 having a central opening 71 extending therethrough. Top plate 76 has a pair of elongated slots 86 for bolt means 82 as shown in FIG. 4. A bottom plate 78 having a central opening 73 also includes a pair of elongated slots 88 extending at right angles to slots 86 to form an adjustable connection. Bottom plate 78 is secured to top plate 76 with bolt means 82 and nuts 84. With the elongated slots 86 in top plate 76 and the elongated slots 88 in plate 78, bottom plate 78 may be adjusted longitudinally and laterally in order to align opening 73 with sleeve 66 of top support assembly 54. A cylindrical cup 80 is secured to bottom plate 78 by weld 75 so that the cylindrical cup is aligned with the central opening in plate 78. A rigid electrical insulator 58 having a smooth cylindrical top 60 and having a smooth cylindrical bottom 62, extends between top support assembly 54 and bottom support assembly 56. Preferably bottom 62 of insulator 58 is inserted within cylindrical cup 80 so that bottom portion 62 slideably engages the inner surface of cylindrical cup 80 and top 60 is inserted within sleeve 66 of top support assembly 54 so that top 60 of insulator 58 slideably engages the inner surface of sleeve 66. Therefore, when collector electrodes 20 and discharge electrode assembly 24 expand and contract due to thermal expansion caused by the heat of the gases passing through precipitator 10, insulator 58 will not crack or break due to stress applied from the contraction and expansion because insulator 58 will slide within sleeve 66 and cylindrical cup 80. Since insulator 58 slideably engages sleeve 66 and cylindrical cup 80, the vertical movement of collector electrodes 20 and discharge electrode assembly 24 will not have any detrimental effect on insulator 58, however, insulator 58 is prevented from lateral movement by cylindrical cup 80, plates 76 and 78, and bolts 82 and nuts 84.

If desired, plate 78 may be made in two halves (not shown) so that each half may be individually adjusted and secured to top plate 78. If plate 78 is made in two halves, cylindrical cup 80 is also made in two halves (not shown) and each half welded to each half of plate 78. In this manner insulator 58 may be installed in sleeve 66 and top plate 86 and then bottom plate 78 and cylindrical cup 80 clamped around bottom 62 of insulator 58 and each half of bottom plate 78 secured to top plate 76 by bolts 82 and nuts 84.

Preferably, insulator 58 has an unglazed outer surface rather than the conventional glazed surface found on most insulators. The unglazed finish on the surface of insulator 58 is preferred over a glazed surface because it gives superior resistance to surface tracking of dust or particles while a glazed surface has poor resistance to surface tracking. By surface tracking, it is meant that when dust collects on the outer surface of electrical insulators, an electrical path is formed on the surface of the insulator and an electrical current may momentarily flow through the dust along the length of the insulator. When this current flows over a glazed surface of an insulator, it burns a track within the surface of the insulator. This track tends to fill up with certain oxides and other material which means a low resistance electrical path is formed along the length of the insulator and an electrical current will flow between the collector electrodes and discharge electrode assembly. This result is undesirable since the discharge electrode assembly must be electrically insulated from the collector electrodes for the electrostatic precipitator to function properly. It has been found that an unglazed surface gives superior resistance to this surface burning or tracking due to an electrical current momentarily flowing along the surface of the insulator through dust that forms on the outer surface. Since a track is not formed as readily on the surface of an unglazed insulator, a current path is not formed and the current will not flow along the surface of the insulator from the collector electrodes to the discharge electrode assembly.

In operation and referring first to FIG. 4, electrically insulating stabilizer means 28 is installed between collector electrodes 20 and bottom weight guide grid frame 36. Top support assembly 54 is secured between bottom rigid beams 32 on adjacent collector electrodes 20. Top support assembly 54 is substantially aligned with a square 51 of bottom weight guide grid frame 36. Bottom support assembly 56 is secured within square 51 of bottom weight guide grid frame 36 substantially aligned with top support assembly 54. Bottom plate 78 of bottom support assembly 56 is disconnected from top plate 76 by loosening bolts 82 and nuts 84. Bottom portion 62 of insulator 58 is inserted within cylindrical cup 80. Top 60 of insulator 58 is then slid within sleeve 66 of top support assembly 54. Ball bushing assembly 64 allows slight rotationl movement of insulator 58 in order to properly align slots 86 and 88 in top plate 76 and bottom plate 78 respectively so that bottom plate 78 fits snuggly up against top plate 76. Bolts 82 are then inserted through slots 86 and 88 in top plate 76 and bottom plate 78 respectively and bottom plate 78 is loosely secured to top plate 76 by nuts 84. Bottom plate 78 is slightly adjusted along slots 86 and 88 in top plate 76 and bottom plate 78 respectively in order to insure that insulator 58 is substantially vertical. Nuts 84 are tightened to secure top plate 76 to bottom plate 78 so that bottom plate 78 will not move. Since bottom part 62 of insulator 58 is slideably recessed within cylindrical cup 80 and plate 76 is rigidly secured to top plate 76, no lateral movement can occur between bottom support assembly 56 and top support assembly 54, thereby rigidly securing and rigidly stabilizing bottom weight guide grid frame 36 to collector electrodes 20.

Once all desired electrically insulating stabilizer means 28 are rigidly secured between collector electrodes 20 and discharge electrode assembly 24, a particle laden gas is passed through inlet port 14 as shown in FIG. 1, and gas passages 22, as shown in FIG. 2, between adjacent collector electrode 20. The discharge wires 38 are then energized which produce an electrostatic field around each discharge wire 38. Ordinarily, this electrostatic field around discharge wires 38 has a tendency to oscillate and swing the discharge wires 38. However, since discharge wires 38 have weights 40 suspended therefrom and since weights 40 are suspended within weight guides 52 attached to grid plates 53 of bottom weight guide grid frame 36, weights 40 and discharge wires 32 are prevented from oscillating and swinging. However, due to the long length of discharge wires 38 and the high intensity electrostatic fields around each discharge wire 38, the electrostatic fields will tend to swing the bottom weight guide grid frame 36 back and forth. However, since collector electrodes 20 are rigidly secured to shell 12 and bottom weight guide grid frame 36 is rigidly secured to bottom rigid beam 32 of collector electrode 20 by electrically insulating stabilizer means 28, bottom weight guide grid frame 36 is prevented from swinging. Since bottom weight guide grid frame 36 is prevented from swinging by electrically insulating stabilizing means 28, discharge wires 38 remain substantially centered between adjacent collector electrodes 20.

As the particle laden gas passes through gas passages 22 between adjacent collector electrodes 20 the electrostatic field around discharge wires 38 ionizes the particles within the gas. These particles are then attracted to and collected on the collector plates 21 of collector electrodes 20. The particles are removed from collector plates 21 by any conventional means such as by rapping the collector electrodes 20 with conventional rappers which dislodge the particles from collector plate 21. The particles fall to the bottom of electrostatic precipitator 10 where they are collected in hopper 48. The particles are disposed of outside the precipitator system in the conventional manner. The clean gas passes through gas outlet port 16 and is removed to the atmosphere by any conventional means such as by a gas stack.

The foregoing has presented an electrostatic precipitator having a novel means of electrically insulating stabilizing the discharge electrode assembly so as to maintain the discharge wires substantially centered between adjacent collector electrodes. The problem of oscillating and swinging discharge wires has been eliminated by providing a rigid electrically insulating stabilizer assembly connected between the discharge electrode assembly and the collector electrode assembly.

Accordingly, the invention having been described in its best embodiment and mode of operation that which is desired to be claimed by Letters Patent is:

1. An electrostatic precipitator for cleaning a particle laden gas passing therethrough comprising:

a shell having a gas inlet port and a gas outlet port and defining a gas chamber therein;

a plurality of laterally spaced collector electrodes suspended within said gas chamber and defining gas passages therebetween;

a discharge electrode assembly suspended within said gas chamber and electrically insulated from said shell by an insulator means connected to said shell and to said assembly, said electrode assembly including:

a. a top support grid spaced above the top of said collector electrodes;

b. a bottom guide grid spaced below the bottom of said collector electrodes;

c. a plurality of longitudinally spaced discharge electrode wires connected to said top support grid and to said bottom guide grid and extending within said gas passages; and d. a plurality of support rods connected to said top support grid and to said bottom guide grid for supporting said bottom guide grid;

and a plurality of electrically insulating stabilizer means connected at one end to lower portions of adjacent collector electrodes and connected at another end to said bottom guide grid for maintaining said discharge electrode wires substantially centered between said adjacent collector electrodes and for preventing said bottom guide grid from swinging due to an electrical field around said discharge electrode wires.

2. The electrostatic precipitator of claim 1 wherein said electrically insulating stabilizer means includes:

a top support assembly connected to said lower portions of said adjacent collector electrodes;

a bottom support assembly connected to said bottom guide grid in substantially vertical alignment with said top support assembly; and a rigid electrical insulator means connected to said top support assembly and to said bottom support assembly for insulating said collector electrodes from said discharge electrode assembly and for maintaining said discharge wires substantially centered between said adjacent collector electrodes in said gas passage.

3. The electrostatic precipitator of claim 2 wherein said top support assembly includes a self-aligning bushing for aligning said top support assembly with said bottom support assembly.

4. The electrostatic precipitator of claim 3 wherein said bottom support assembly includes an adjustable plate means for aligning said bottom support assembly with said top support assembly.

5. The electrostatic precipitator of claim 4 wherein said adjustable plate means includes a recess for receiving one end of said insulator means.

6. The electrostatic precipitator of claim 5 wherein said insulator means is slidably connected to said top support assembly and said bottom support assembly for allowing relative vertical movement between said collector electrodes and said discharge electrode assembly due to thermal expansion.

7. The electrostatic precipitator of claim 2 wherein said rigid electrical insulator means has an unglazed outer surface for maintaining insulating properties of said insulator means.

8. An electrostatic precipitator for cleaning a particle laden gas passing therethrough, comprising:

a shell having a gas inlet port and an outlet port and defining a gas chamber therein;

a plurality of laterally spaced collector electrodes suspended within said gas chamber and defining gas passages therebetween;

a discharge electrode assembly suspended from an insulating means within said gas chamber, a portion thereof suspended within said gas passages between said adjacent collector electrodes, said discharge electrode assembly being insulated by said insulating means from said shell;

said discharge electrode assembly including;

a top support grid spaced above the top of said collector electrodes, a bottom guide grid spaced below the bottom of said collector electrodes, and a plurality of longitudinally spaced discharge electrode wires connected to said top support grid and to said bottom guide grid and extending within said gas passages;

a plurality of electrically insulating stabilizer means connected to selected ones of said collector electrodes and to said discharge electrode assembly for maintaining said portion of said discharge electrode assembly substantially centered between said adjacent collector electrodes; and said electrically insulating stabilizer means including;

a top support assembly connected to lower portions of said adjacent collector electrodes, a bottom support assembly connected to said bottom guide grid in substantially vertical alignment with said top support assembly, and a rigid electrical insulator means connected to said top support assembly and to said bottom support assembly for insulating said collector electrodes from said discharge electrode assembly and for maintaining said discharge wires substantially centered between said adjacent collector electrodes in said gas passages, and for preventing said bottom guide grid from swinging due to an electrical field around said discharge electrode wires.

* * * * *